United States Patent [19]

Kozarek et al.

[11] Patent Number: 4,596,637

[45] Date of Patent: Jun. 24, 1986

[54] APPARATUS AND METHOD FOR ELECTROLYSIS AND FLOAT

[75] Inventors: Robert L. Kozarek, Washington Township, Fayette County; Thomas R. Hornack; Noel Jarrett, both of Lower Burrell, all of Pa.

[73] Assignee: Aluminum Company of America, Pittsburgh, Pa.

[21] Appl. No.: 488,749

[22] Filed: Apr. 26, 1983

[51] Int. Cl.[4] ..... C25B 1/00; C25C 1/02; C25C 3/00; C25C 7/02

[52] U.S. Cl. ..... 204/67; 204/64 R; 204/64 T; 204/59 R; 204/60; 204/243 R; 204/247; 204/284; 204/286

[58] Field of Search ..... 204/1 R, 67, 68, 247, 204/243 R, 245, 250, 59 R, 60, 64 R

[56] References Cited

U.S. PATENT DOCUMENTS

| | | | |
|---|---|---|---|
| 400,664 | 4/1889 | Hall . | |
| 2,480,474 | 8/1949 | Johnson | 204/67 |
| 3,215,615 | 11/1965 | Ransley | 204/279 |
| 3,554,893 | 1/1971 | de Varda | 204/244 |
| 3,578,580 | 5/1971 | Schmidt-Hatting et al. | 204/243 |
| 3,730,859 | 5/1973 | de Varda | 204/67 |
| 3,745,107 | 7/1973 | Jacobs | 204/243 R |
| 3,755,099 | 8/1973 | Haupin | 204/64 R |
| 3,785,941 | 1/1974 | Jacobs | 204/67 |
| 3,822,195 | 7/1974 | Dell et al. | 204/64 |
| 3,930,967 | 1/1976 | Alder | 204/67 |
| 3,960,678 | 6/1976 | Alder | 204/67 |
| 4,110,178 | 8/1978 | LaCamera et al. | 204/64 R |
| 4,140,594 | 2/1979 | Rogers et al. | 204/67 |
| 4,177,128 | 12/1979 | Rahn | 204/243 R |
| 4,179,345 | 12/1979 | Das | 204/67 |
| 4,219,391 | 8/1980 | Foster | 204/67 |
| 4,243,502 | 1/1981 | Kugler | 204/243 R |
| 4,288,309 | 9/1981 | Cohen | 204/225 |
| 4,297,180 | 10/1981 | Foster | 204/67 |
| 4,308,113 | 12/1981 | Das | 204/67 |
| 4,338,177 | 7/1982 | Withers et al. | 204/243 R |
| 4,349,427 | 9/1982 | Goodnow et al. | 204/243 R |
| 4,405,433 | 9/1983 | Payne | 204/225 |
| 4,462,886 | 7/1984 | Kugler | 204/284 |
| 4,532,017 | 7/1985 | Keinborg et al. | 204/67 |

FOREIGN PATENT DOCUMENTS 82096 6/1983 European Pat. Off. .

OTHER PUBLICATIONS

"Advances in the Smelting of Aluminum", Jarrett et al, The Metallurgical Society of AIME, 1981.

Article Reprint, Aluminium-Verlag GmbH, Germany, 1981, "Inert Cathodes and Anodes for Aluminium Electrolysis", Billehaug and Øye.

*Primary Examiner*—Howard S. Williams

*Attorney, Agent, or Firm*—Douglas G. Glantz

[57] ABSTRACT

An electrolytic cell is disclosed including means for holding a first electrode in position relative to a second electrode to form an inter-electrode zone of specified dimension for containing the electrolyte; the means for holding including float means adapted for supporting the first electrode essentially free from support by internal surfaces of the cell; and conductive means for electrically connecting one electrode to a separate liquid pad of higher conductivity than the electrolyte.

An electrolytic method is disclosed including floating a first electrode essentially free from support by the internal surfaces of an electrolytic cell; arranging a second electrode spaced from the first electrode to form an inter-electrode zone for containing electrolyte; and connecting one electrode electrically with a separate liquid pad of higher conductivity than the electrolyte.

27 Claims, 15 Drawing Figures

APPARATUS AND METHOD FOR ELECTROLYSIS AND FLOAT

BACKGROUND OF THE INVENTION

1. Technical Field

This invention relates to cell and method for the electrolysis of a compound and to the production of a metal such as aluminum by electrolysis of a compound of the metal such as alumina in a molten electrolyte such as cryolite.

2. Description of Conventional Art

Electrolysis involves an electrochemical oxidation-reduction associated with the decomposition of a compound. An electrical current passes between two electrodes and through an electrolyte, which can be the compound alone, e.g., sodium chloride, or the compound dissolved in a liquid solvent, e.g., alumina dissolved in cryolite, such that a metallic constituent of the compound is reduced together with a correspondent oxidation reaction. The current is passed between the electrodes from an anode to a cathode to provide electrons at a requisite electromotive force to reduce the metallic constituent which usually is the desired electrolytic product, such as in the electrolytic smelting desired reaction depends on the nature of the compound and the composition of the electrolyte. However, in practical application, the cell power efficiency of a particular electrolytic cell design can result in wasted energy depending on factors such as, inter alia, cell voltage and current efficiency.

Much of the voltage drop through an electrolytic cell occurs in the electrolyte and is attributable to electrical resistance of the electrolyte, or electrolytic bath, across the anode-cathode distance. The bath electrical resistance or voltage drop in conventional Hall-Heroult cells for the electrolytic reduction of aluminum from alumina dissolved in a molten cryolite bath includes a decomposition potential, i.e., energy in aluminum product, and an additional voltage attributable to heat energy generated in the inter-electrode spacing by the bath resistance, which heat energy generally is discarded. Such discarded heat energy typically makes up 35 to 45 percent of the total voltage drop across the cell, and in comparative measure, as much as up to twice the voltage drop attributable to decomposition potential. Reducing the anode-cathode separation distance is one way to decrease this energy loss.

However, whenever the anode-cathode distance is reduced, short circuiting of the anode and cathode must be prevented. In a conventional Hall-Heroult cell using carbon anodes held close to, but separated from, a metal pad, this shorting is caused by an induced displacement of the metal in the pad. Such displacement can be caused in large part by the considerable magnetic forces associated with the electrical currents employed in the electrolysis. For example, magnetic field strengths of 150 gauss can be present in modern Hall-Heroult cells. This metal displacement can take the form of (1) a vertical, static displacement in the pad, resulting in an uneven pad surface such that the pad has a greater depth in the center of the cell by as much as 5 cm; (2) a wave-like change in metal depth, circling the cell with a frequency of on the order of 1 cycle/30 seconds; and (3) a metal flow with flow rates of 10–20 cm/second being common. Thus, to prevent shorting, the anode-cathode separation must always be slightly greater than the peak height of the displaced molten product in the cell. In the case of aluminum production from alumina dissolved in cryolite in a conventional Hall-Heroult cell, such anode-cathode separation is held to a minimum distance, e.g., of 4.0–4.5 cm.

Another adverse result from reducing anode-cathode distance is a significant reduction in current efficiency of the cell when the metal produced by electrolysis at the cathode is oxidized by contact with the anode product. For example, in the electrolysis of aluminum from alumina dissolved in cryolite, aluminum metal produced at the cathode can be oxidized readily back to alumina or aluminum salt by a close proximity to the anodically produced carbon oxide. A reduction in the anode-cathode separation distance provides more contact between anode product and cathode product and significantly accelerates the reoxidation of reduced metal, thereby decreasing current efficiency.

A consumable anode, such as the carbon anode conventionally used in the production of aluminum in a conventional Hall-Heroult cell, presents a substantial obstacle to achieving a precise control of inter-electrode spacing. In the conventional Hall-Heroult cell, oxygen gas produced at the anode combines with the carbon of the anode itself to form a carbon oxide, such as carbon monoxide and carbon dioxide gas. Oxidation of the anodes according to the overall reaction $$Al_2O_3+3/2\ C \rightarrow 2\ Al+3/2\ CO_2,$$

together with air burning of the anodes, consumes about 0.45 pounds of carbon for each pound of aluminum produced. This carbon loss in well-designed cells is largely offset by metal accumulation in the metal pad cathode of the Hall-Heroult cell, theoretically maintaining electrode spacing. However, in a cell with multiple carbon anodes, each has unique electrical properties and will have a different stage of consumption. For a number of such practical considerations, anode height must be monitored and adjusted frequently in conventional Hall-Heroult cell practice.

One direction taken to overcome the problem of anode consumption is disclosed in Haupin, U.S. Pat. No. 3,755,099, and related patents, such as U.S. Pat. No. 3,822,195, U.S. Pat. No. 4,110,178, U.S. Pat. No. 4,140,594, U.S. Pat. No. 4,179,345, and U.S. Pat. No. 4,308,113, which involve the production of a metal such as aluminum or magnesium electrolytically from the metal chloride dissolved in a molten halide of higher decomposition potential. Since an oxygen species is absent, the problem of oxygen gas combining with carbon anodes is avoided. In the absence of oxygen, carbon electrodes can be stacked one above the other in a spaced relationship established by interposed refractory pillars, as shown in FIG. 1 of U.S. Pat. No. 3,755,099. The pillars are sized to space the electrodes closely as for example by less than ¾ inch (1.91 cm). The electrodes depicted in the figures of the above-referenced patents are shown to be rigidly supported horizontally by the wall of the cell.

Another direction is DeVarda, U.S. Pat. No. 3,554,893, which shows an electrolytic furnace having carbon electrodes that do not contact the floor or wall of the furnace. Spacers, e.g., of electrically insulating refractory material, separate the electrodes against an upward thrust exerted upon them by the bath (the bath density being higher than that of the carbon). The spacers are not attached to any electrode but rather are held in place by the upward thrust of the bath acting upon the more buoyant graphite. In DeVarda, the carbon electrodes are used in the electrolytic decomposition of alumina dissolved in a bath of cryolite and thereby are consumed at the anodic portions.

DeVarda employs an inter-electrode zone similar to a conventional Hall-Heroult cell, i.e., a large anode-cathode separation between the metal pad on the base of the cell and the last or lower carbon electrode. DeVarda employs cathodes consisting of metal pad, which represents a further similarity to the Hall-Heroult process. In another aspect, it would appear that the electrodes shown in DeVarda would sink at some point when enough carbon is consumed and sufficient metal builds up in the concave cathode reservoir to exceed a reduced buoyancy of the consumed electrode.

Jacobs, U.S. Pat. No. 3,785,941, like Haupin and others discussed above, relates to chloride electrolysis. This patent discloses that the aluminum chloride-containing electrolyte tends to react with conventional refractory materials. Nitride-based refractory material is applied, e.g., as material for a spacer between the anode and cathode, in order to overcome this problem. Jacobs shows the cathode supported by the cell floor.

Alder, U.S. Pat. No. 3,930,967, shows the production of aluminum from aluminum oxide where electric power is passed through a multi-cell furnace with at least one inconsumable bipolar electrode, including an anode of a ceramic oxide. The interpolar distance is held constant by electrodes which are rigidly fixed to the floor or wall of the cell.

Foster, U.S. Pat. No. 4,297,180, shows the use of a cathode grate or hollow body for protruding the cathode surface toward the anode and above the liquid pad formed on the cell bottom. The cathode elements are shown to be supported by the floor of the cell.

Cohen, U.S. Pat. No. 4,288,309, discloses the use of consumable electrodes and spacing between two consecutive electrodes, which spacing nevertheless remains constant irrespective of the degree of erosion of the consumable electrodes. Spacer elements, having the same thickness and shaped in the form of balls, are threaded on vertical wires attached to horizontal bars associated with the top portion of the tank. The Cohen patent mentions electrolysis of liquid solutions such as sea water. Cohen does not appear to use a liquid pad of electrolytic product separate from the electrolyte.

Vertical electrodes are well known in electrolysis processes and were shown as early as Hall, U.S. Pat. No. 400,664. The Hall process disclosed therein avoided contacting the electrodes with the liquid aluminum product when the electrode was not an integral part of the internal cell surface. Alder, U.S. Pat. No. 3,930,967, shows an example of vertical bipolar electrodes, which as discussed hereinbefore are rigidly fixed to the floor or wall of the cell.

Ransley, U.S. Pat. No. 3,215,615, shows an example of inclined monopolar electrodes for producing aluminum at inclined cathodes which are rigidly fixed in the internal floor surface of the cell. The inclined anode is a consumable anode and is shown having a conical profile.

DeVarda, U.S. Pat. No. 3,730,859, is illustrative of a bipolar electrode assembly having inclined surfaces. DeVarda '859 does not disclose the manner of supporting electrodes in the cell. Further, DeVarda '859 discloses electrically connecting the cathode to a power supply not through the liquid metal pad but rather through current-supply connecting bars external to the cell.

INTRODUCTION TO THE INVENTION

A significant problem develops, and is exemplified in fluoride electrolysis, when the electrode is supported by the floor or the wall of the electrolytic cell, the problem deriving from a warping of internal surfaces of the cell, e.g., the floor or the wall, which occurs during the operation of the cell under normally harsh operating conditions. Such warping will destroy a specified or particular electrode placement or positioning when the electrodes are fixed to or supported by the floor or wall of the cell.

The present invention as claimed has the object of providing a remedy for the problems and drawbacks associated with conventional electrolytic cells and processes, such as problems discussed in the previous section and further including, inter alia, problems relating to fluoride electrolysis, including problems associated with operating with a liquid metal pad cathode or problems associated with the rigid attachment of the electrode to the floor or the wall of the electrolytic cell. This latter particular drawback becomes a critical problem with any attempt to incorporate a specified and essentially fixed anode-cathode distance. The problem shows up as a result of the warping or undulation over time of the surfaces of the internal floor or wall in the cell, which warping or undulation of the cell internal surfaces destroys any fixed anode-cathode distance in conventional cells in response to the high temperatures and corrosive materials contained in the cell.

The present invention has the object of solving the problem of how to achieve and operate an electrolytic cell having a specified anode-cathode distance which can be maintained very small over a longer period of time than previously possible. Moreover, the present invention in one aspect has the object of achieving and operating such an electrolytic cell while accommodating the electrolysis of alumina in cryolite to form aluminum, which previously was limited by problems such as, among others, those aspects associated with the operation of an electrolytic cell to accommodate the combination of oxygen with the carbon of the anode.

A primary object of the present invention includes an ability to establish an inter-electrode zone having a specified dimension which is essentially fixed in an electrolytic cell and which can be maintained to provide a small and uniform anode-cathode distance in such a way to reduce the voltage drop across the electrolyte bath and increase the power efficiency of the cell.

A still further object is the ability to operate at such a reduced and essentially fixed anode-cathode distance over a period of time longer than previously possible.

Another object of the present invention in one aspect involves an ability to establish a cathode surface other than the liquid pad of electrolytic product and to operate an electrolytic cell and process having such a cathode surface without detrimental effect by movement from the internal floor or the wall of the cell, e.g., as would occur in fluoride electrolysis, while maintaining a contact between one electrode and a separate liquid pad having a higher conductivity than the electrolyte.

A further object of the present invention in one aspect includes an ability to produce aluminum from alumina dissolved in a cryolite-containing bath in an electrolytic cell and process employing a reduced and essentially fixed anode-cathode distance maintainable over a longer period than previously available.

SUMMARY OF THE INVENTION

The above objects are achieved and other problems of the prior art are overcome by the present invention which includes apparatus and method for electrolysis.

The electrolytic apparatus or cell of the present invention includes means having an internal surface for containing an electrolyte and a separate liquid pad of higher conductivity than the electrolyte, first and second electrodes within the means for containing, means for holding the first electrode in a position relative to the second electrode to form an inter-electrode zone of specified dimension for containing the electrolyte, wherein the means for holding includes float means for supporting the first electrode essentially free from support by the internal surface of the means for containing, and conductive means for electrically connecting one electrode to the pad.

The method of the present invention includes carrying out a process of electrolysis employing the electrolytic cell of the present invention or alternatively floating a first electrode in a cell having an internal surface for containing an electrolyte and a separate liquid pad of higher conductivity than the electrolyte, the first electrode being essentially free from support by the internal surface of the cell; arranging a second electrode spaced from the first electrode to form an inter-electrode zone for containing the electrolyte; and connecting one electrode electrically with the pad.

BRIEF DESCRIPTION OF DRAWINGS

In the accompanying drawings.

DETAILED DESCRIPTION

Figure 1:
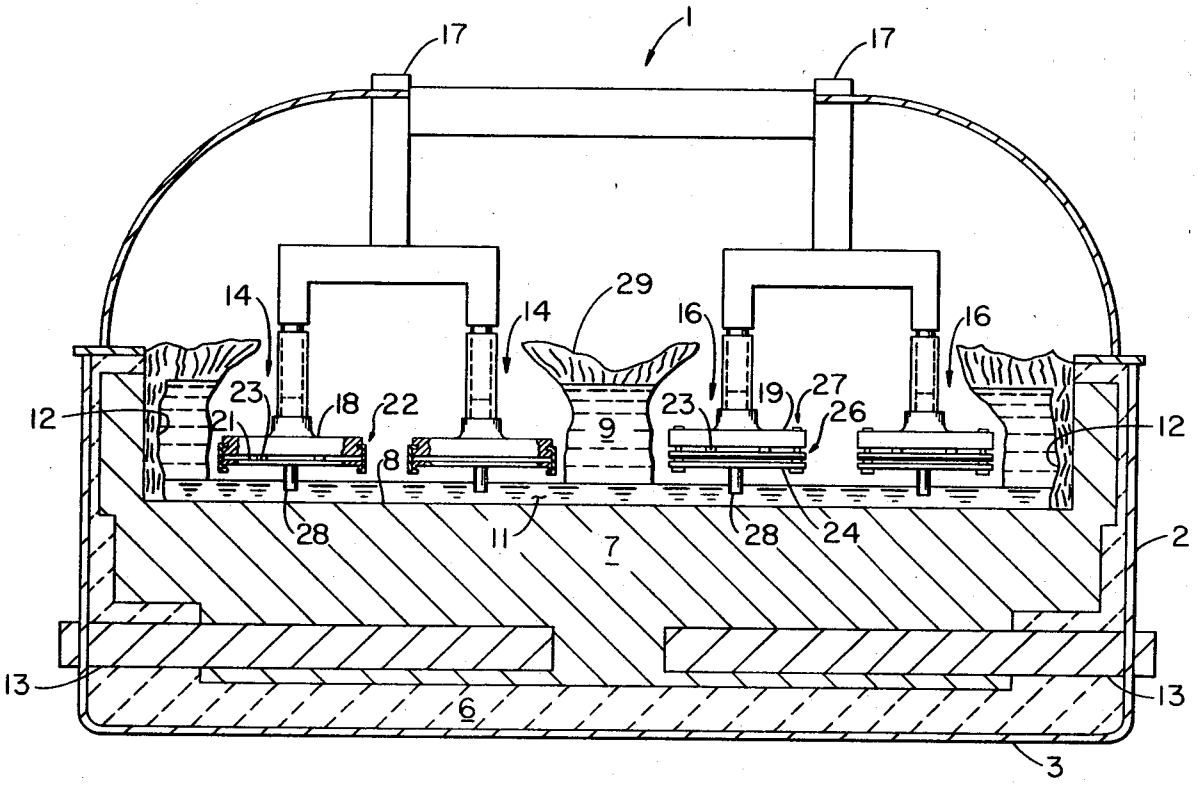
FIG. 1 is a sectional elevation view of an electrolytic cell in accordance with the present invention and having multiple electrode assemblies.

Reference is directed to FIG. 1 wherein an electrolytic cell of the present invention is illustrated in a Hall-Heroult cell context. Electrolytic cell 1 has exterior side 2 and base 3 forming an outside steel shell 4. Steel shell 4 is lined with an insulating material 6, and internally thereof, electrically conductive material 7, e.g., of carbon, including internal cell floor 8. Floor 8 forms part of an internal surface of a containing means of the cell capable of containing molten electrolyte 9 and a separate liquid metal pad 11 wherein the metal product of the electrolysis collects. Metal pad 11 has an electrical conductivity which is higher than that of the electrolyte. In this embodiment, another part of the internal containing surface is formed by frozen electrolyte side wall 12. Unlike side wall 12, floor 8 is capable of conducting current for the electrolysis. Electrical current collector bars 13 of a material such as steel are adapted to make good electrical contact with carbonaceous cell liner 7.

Multiple electrode assemblies are illustrated in FIG. 1 including a group 14 of monopolar anode-cathode assemblies and a group 16 of bipolar anode-cathode assemblies. Anode rods 17 of a highly conductive material such as copper or aluminum are electrically connected to monopolar anode 18 or to terminal anode 19. The anodes preferably are composed of a material inert to the corrosive environment of the cell and, in the case of aluminum production from alumina dissolved in a molten salt bath, e.g., of cryolite, are particularly inert to anode products such as oxygen gas. Nevertheless, the present invention is not limited to the use of inert anode materials. Anode rods 17 are supported from a position (not shown) external to the internal cell surfaces, e.g., the internal surface formed by cell floor 8.

Monopolar cathode 21 is held in position relative to monopolar anode 18 by holding means comprising supporting means 22 and positioning means such as spacer 23 such that an inter-electrode zone (more particularly identified in subsequent figures) is formed for containing electrolyte and such that the cathode is essentially free from support by floor surface 8 or wall 12. The holding means which in one embodiment comprise said supporting means 22 and said spacer 23 are illustrated in this and other embodiments more fully in subsequent figures.

Terminal cathode 24 and bipolar electrode 26 are similarly adapted to be positioned relative to each other and to terminal anode 19 in the bipolar electrode assembly by holding means comprising supporting means 27 and spacer 23. Holding means for bipolar electrode assemblies are more fully described hereinafter and illustrated in subsequent figures.

Spacers 23, of a non-conductive material, are capable of withstanding the corrosive environment associated with a contact with the electrolyte and the cathodic product. Such spacers are positioned between adjacent anodes and cathodes to establish an inter-electrode zone of specified dimension. The term "specified" dimension is meant to designate a predetermined or preferred distance or range of distances which when established effectively operates to produce electrolytic product efficiently in the inter-electrode zone. For example, in the case of aluminum production in an electrolytic cell and method of the present invention, such a specified dimension would be less than about 4.0 cm and, preferably, would be less than about 1.7 cm and would be calculated and predetermined to achieve an efficient production of metal with a minimal anode-cathode distance.

Bulk material 29 of a compound intended for electrolysis is fed into the top of cell 1 and enters electrolyte 9. Electrolyte is contained in the inter-electrode zone formed between any anode and cathode, e.g., between monopolar anode 18 and monopolar cathode 21, between terminal anode 19 and the cathodic top surface of bipolar electrode 26, and between the anodic bottom surface of bipolar electrode 26 and terminal cathode 24. Liquid electrolytic product formed in any inter-electrode zone collects in a separate and discrete liquid pad 11 on floor 8. In the case of an electrolysis of a metal compound to form a metal at the cathode, the metal so formed as liquid electrolytic product typically has a higher electrical conductivity than the electrolyte bath, as in the case of aluminum production from alumina dissolved in an electrolyte bath of cryolite. When this metal collects in the separate and discrete liquid pad 11, the resulting liquid metal pad can retain an electrical conductivity which is higher than the electrolyte.

Cathodes 21 and 24 are electrically connected to liquid pad 11, the connecting means being shown in FIG. 1 in the form of an extension 28 of the cathodes themselves. In the embodiment illustrated, the extension has the form of a tail portion on the cathode.

Current is passed from monopolar anode 18 to monopolar cathode 21 or, in a parallel direction thereto, from terminal anode 19 to the top of bipolar electrode 26 and from bipolar electrode 26 to terminal cathode 24. The direct current passing from the anode to the cathode through the inter-electrode zone of specified dimension produces an electrochemical reaction in the electrolyte contained in the inter-electrode zone to reduce a metallic constituent at the cathode and to produce an oxidation reaction at the anode. The metallic constituent formed at the cathode surfaces in cell 1 collects in liquid pad 11 which can be controllably discharged from cell 1 through a discharge port (not shown).

The elevations above metal pad 11 of electrode groups 14 or 16 and the depth of the metal pad are controlled by raising and lowering the groups and by tapping metal from the pad. In this manner, cathode surface 21 in a monopolar electrode assembly and terminal cathode 24 in a bipolar electrode assembly are each provided with a primary cathodic surface which is maintained above the surface of liquid pad 11. The term "primary" as used here in regard to a primary electrode surface, e.g., a primary cathodic surface, is meant to designate electrode surfaces which are closest to adjacent oppositely charged electrode surfaces, such primary electrode surfaces being where electrolytic activity primarily occurs.

Figure 2:
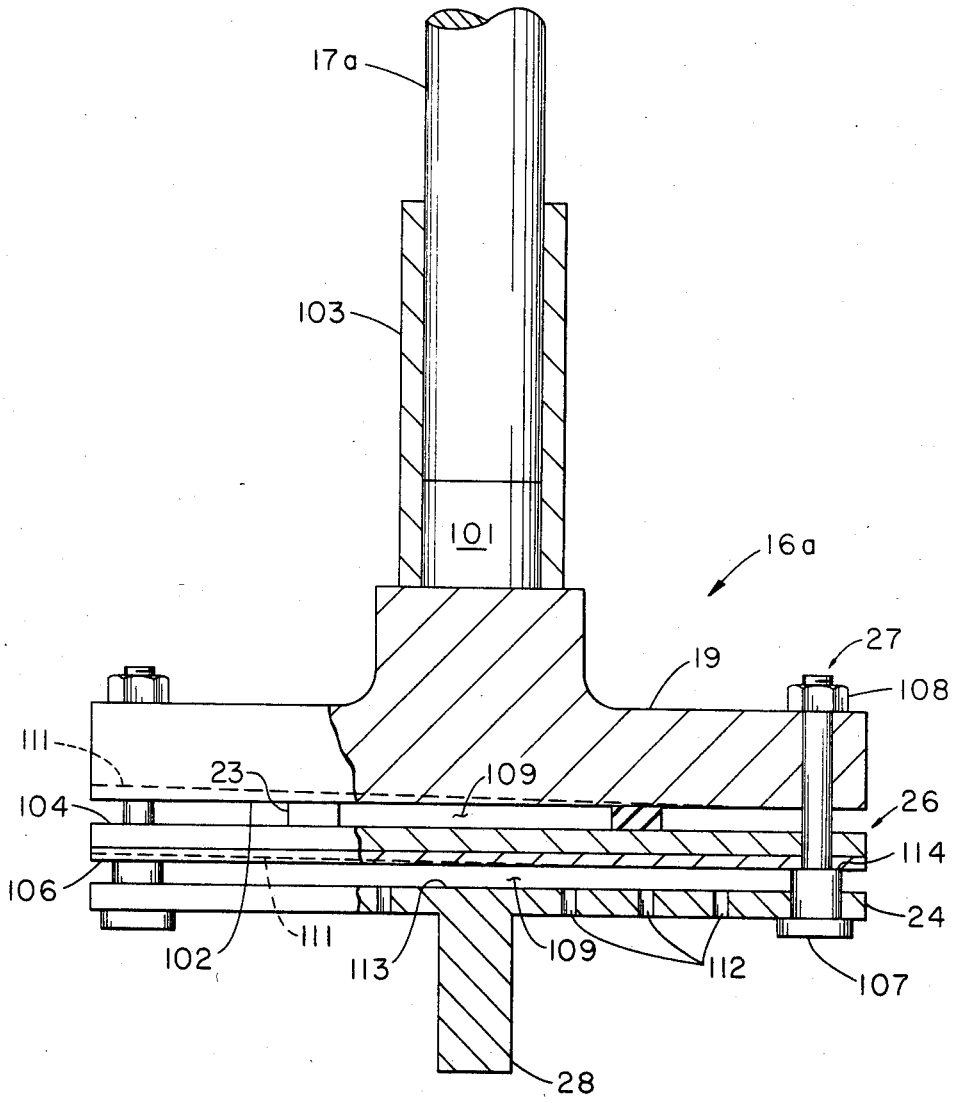
FIG. 2 is an elevational view, partially in section, of an electrode assembly in accordance with the present invention, incorporating a shoulder pin support member.

Referring now to FIG. 2, a bipolar electrode assembly in accordance with the present invention is illustrated generally as 16*a*. Anode rod 17*a* is electrically connected to a current transfer material 101 such as nickel. Current transfer material 101 is attached or welded to terminal anode 19 to facilitate the transfer of direct current at high amperage and at low voltage from rod 17*a* to terminal anode 19. Sleeve 103 protects this junction area from exposure, e.g., from oxygen attack or corrosive influence at the electrolyte-air interface.

Bipolar electrode 26 has a composite, laminated construction such that the cathode portion, e.g., the top portion as illustrated here in the case of an essentially horizontal bipolar electrode assembly, is constructed of a material particularly adapted to function as a primary cathodic surface 104, e.g., a boride. The anodic portion, e.g., the bottom portion of the essentially horizontal bipolar electrode, is constructed of a material particularly suited as a primary anodic surface material, e.g., a ceramic metal oxide as discussed below.

Any electrode serving as an anode in the electrolytic cell of the present invention can be viewed as having a "primary" electrode surface such as primary anodic surface 102 or 106 since most of the anode will serve to conduct current but a primary anodic surface nearest the adjacent cathode will provide current to a path consisting of the least distance between electrodes and will serve to provide current to the least resistant path through the electrolyte. Similarly, the bipolar electrode 26 serving as a cathode can be thought of as having a primary cathodic surface 104 protruding toward the anode.

Anode 19 in one embodiment preferably is composed of a material inert to the electrolyte and the corrosive environment of an electrolytic cell, including at the elevated operating temperatures required in the case of production of a metal, e.g., metals such as aluminum or magnesium. In the case of the electrolytic production of aluminum from alumina dissolved in cryolite, the material for anode 19 can be an inert anode material such as a ceramic metal oxide. See in this connection the articles of Billehaug and Oye, "Inert Anodes for Aluminum Electrolysis in Hall-Heroult Cells," *Aluminum* 57 (1981) 2, pp. 146–150, 228–231.

Bipolar electrode 26, having primary cathodic surface 104 and primary anodic surface 106, and terminal cathode 24 are positioned relative to each other and to terminal anode 19 by holding means incorporating supporting means as illustrated in one embodiment here in the form of shoulder pin 107. Shoulder pin 107 comprises a support member adapted to hang electrode 26 and cathode 24 from anode 19. The shoulder pin supporting means provides a support for the electrode assembly such that in this embodiment the electrodes are held essentially free from support by internal surfaces (not shown) of the electrolytic cell.

Shoulder pin 107 is attached to terminal anode 19 by fastener 108. Fastener 108 also provides a means for adjusting the position of adjacent electrodes. Such adjusting means can take the form of a mechanical fastener such as a nut threadably adapted to adjust shoulder pin 107 against the terminal-cathode 24 and bipolar electrode 26. In this manner the position of the electrodes can be adjusted to conform to a relative position against spacers 23 and to form inter-electrode zone 109 of a specified and essentially fixed dimension. In some cases, fastener nut 108 will be backed off from a tight condition to allow an acceptable range of electrode movement in response to potentially destructive forces, e.g., thermal and chemical forces within the cell, thereby accommodating such forces without destroying electrode integrity.

Positioning means as illustrated here in the form of spacers 23 of electrically insulating material capable of withstanding the corrosive environment of the electrolytic cell are disposed by way of example between anode 19 and bipolar electrode 26 to form an inter-electrode zone 109 of a specified dimension. Spacers 23 also may be positioned between bipolar electrode 26 and terminal cathode 24. Alternatively as incorporated in one embodiment shown here for positioning cathode 24 relative to anodic surface 106, shoulder pin 107 can be adapted to have a shoulder 114 which functions to position terminal cathode 24 and bipolar electrode 26 to form an inter-electrode zone 109 of specified dimension.

Anodic surface 102 of anode 19 and the anodic surface 106 of bipolar electrode 26 have inclined channels 111 for withdrawing gas produced by the electrolysis. Gas is withdrawn and channeled in a direction away from inter-electrode zone 109. Gas movement in channels 111 provides a motive force for circulating electrolyte through interelectrode zone 109.

Terminal cathode 24 has slots or perforations 112 for facilitating run-off of electrolytic product formed on its primary cathodic surface 113. Slots 112 in terminal cathode 24 also provide access for fresh electrolyte to enter inter-electrode zone 109. Grooves may be employed in the top portion of bipolar electrode 26, e.g., in cathodic portion 104 (although not shown), to facilitate the run-off of electrolytic product formed on primary cathodic surface 104. Such cathode grooves preferably are aligned to direct metal run-off flow substantially parallel with circulating electrolyte through inter-electrode zone 109. Grooves in bipolar electrode 26 preferably do not extend as holes entirely through the electrode, e.g., do not extend vertically entirely through a horizontal bipolar electrode, for the reason that such holes would provide a current bypass avoiding metal production at the primary cathodic surface of the bipolar electrode.

Figure 3:
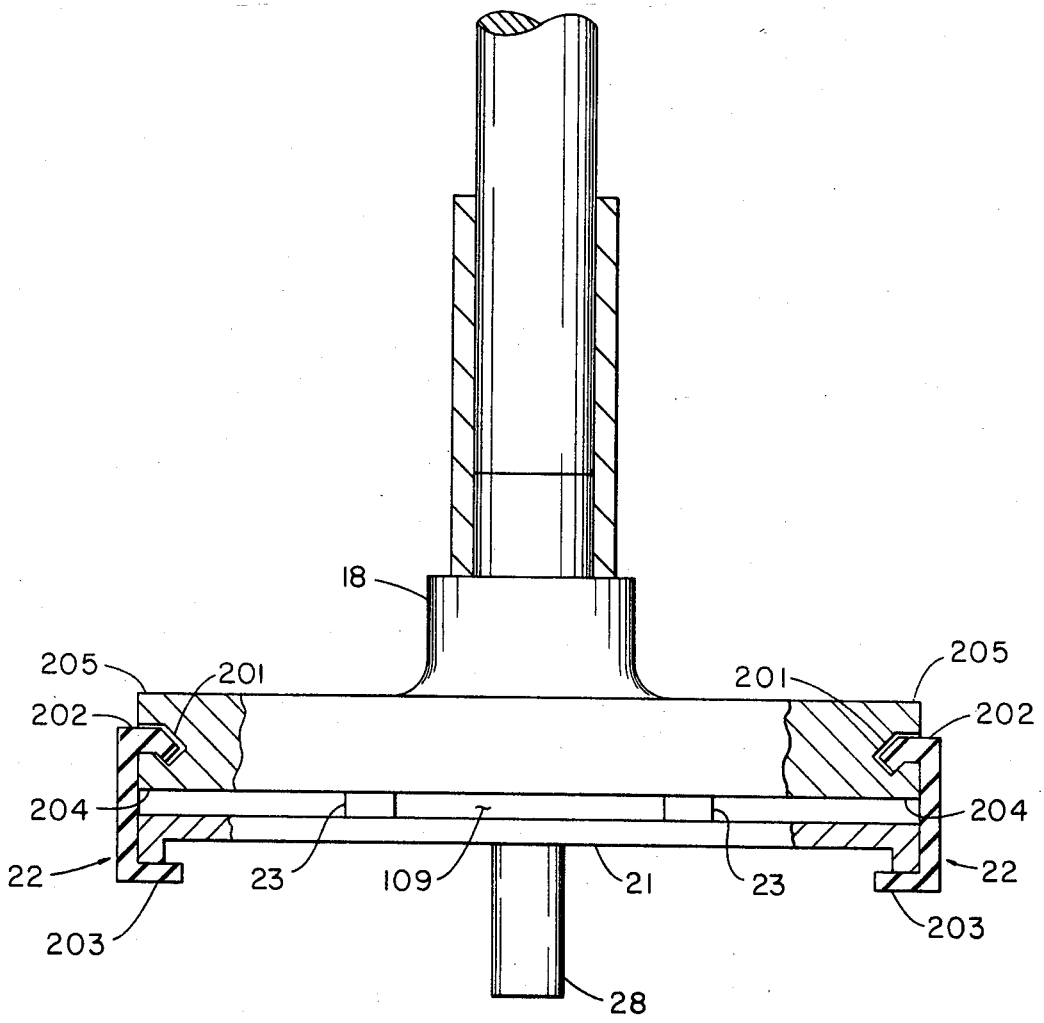
FIG. 3 is an elevational view, partially in section, of an electrode assembly in accordance with the present invention, incorporating a U-shaped bracket support member.

FIG. 3 illustrates a monopolar anode-cathode assembly including anode 18 having notch 201 capable of accepting a support member including by way of example a hanger support bracket 22, here having an upper arm 202 forming one end of a substantially U-shape bracket having lower arm 203. Support brackets 22 comprise supporting means for supporting one electrode essentially free from support by the internal cell floor (not shown). Support bracket 22 is adapted to hang cathode 21 from anode 18. Support brackets 22 and spacers 23 comprise holding means to support cathode 21, to hold cathode 21 in position relative to anode 18, and to maintain an inter-electrode zone 109 of specified dimension. Terminal corner 204 of anode 18 can be enlarged (not shown), and support bracket 22 can be made in a shape suitable for resting on such an enlarged corner, thereby eliminating the need for a machining operation to form notch 201.

In another embodiment, upper arm 202 of support bracket 22 can rest on the upper corner 205 of anode 18. In this way, notch 201 can be eliminated while maintaining suitable supporting means. Support bracket 22 should have a slender configuration of minimal dimension to minimize any restriction of electrolyte flow to inter-electrode zone 109.

Figure 4:
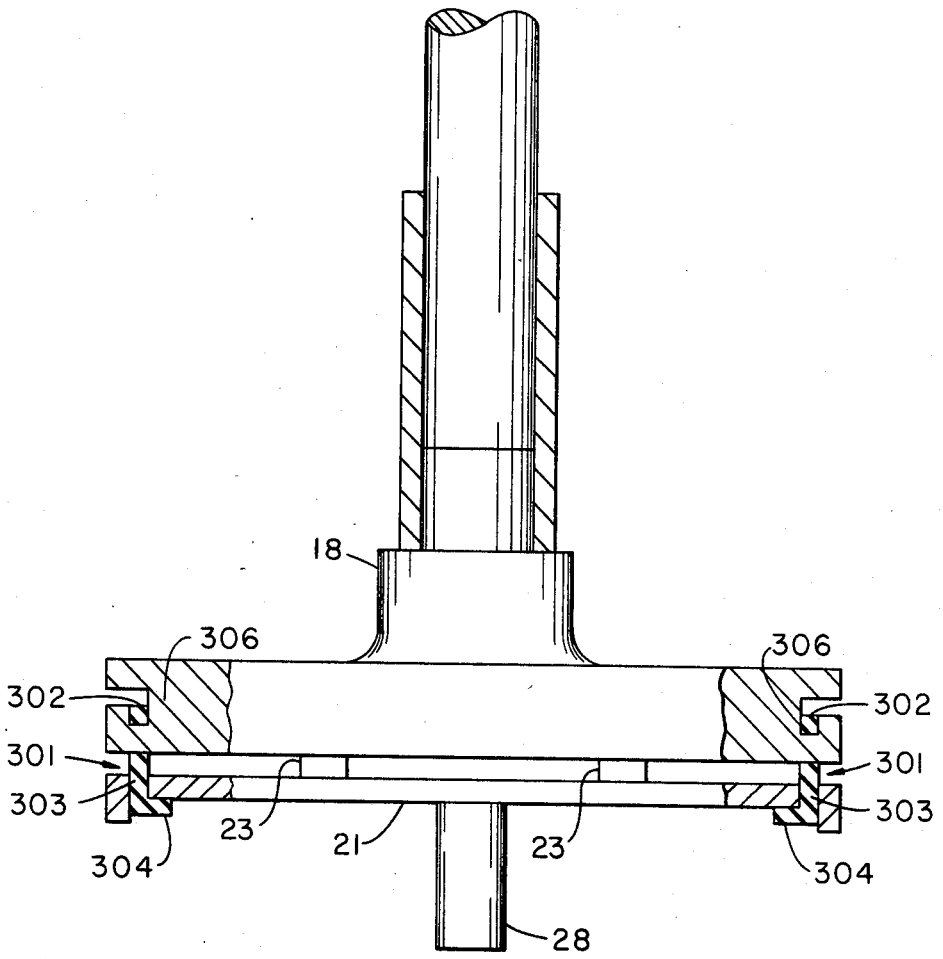
FIG. 4 is an elevational view, partially in section, of an electrode assembly in accordance with the present invention, incorporating a support member comprising a hanger having two arms.

FIG. 4 illustrates another form of supporting means, i.e., hanger 301, for supporting cathode 21 from anode 18. Hanger 301 has two arms, one arm 302 being an extension of a main body 303, arm 302 being positioned at a substantial angle relative to the other arm 304 on the body, e.g., at an angle substantially of about 90° as illustrated in one embodiment in FIG. 4, for the purpose of establishing hanger 301 in anode notch 306. Mechanical fasteners or similar means for fastening (not shown) can be employed to attach the support bracket or hanger to the anode or to the cathode. As discussed hereinbefore, spacer 23 is employed to maintain a specified dimension of the inter-electrode zone.

Figure 5:
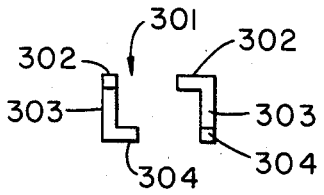
FIG. 5 illustrates a side view and an elevational view of the support member shown in FIG. 4.

FIG. 5 provides elevation and side views of hanger 301 for the purpose of a more complete illustration of hanger 301.

Figure 6:
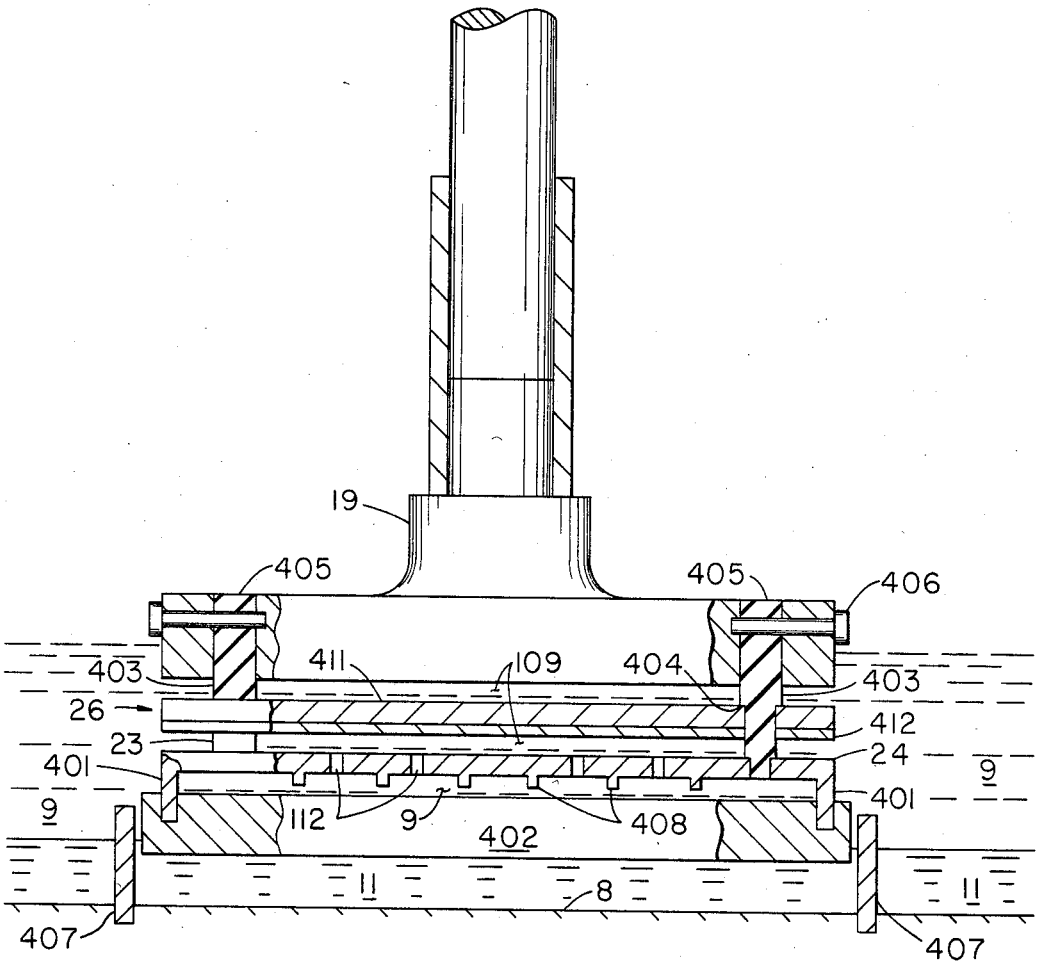
FIG. 6, FIG. 7, FIG. 8, and FIG. 9 are elevational views, partially in section, each of an electrolytic cell and electrode assembly in accordance with the present invention, incorporating float supporting means.
Figure 7:
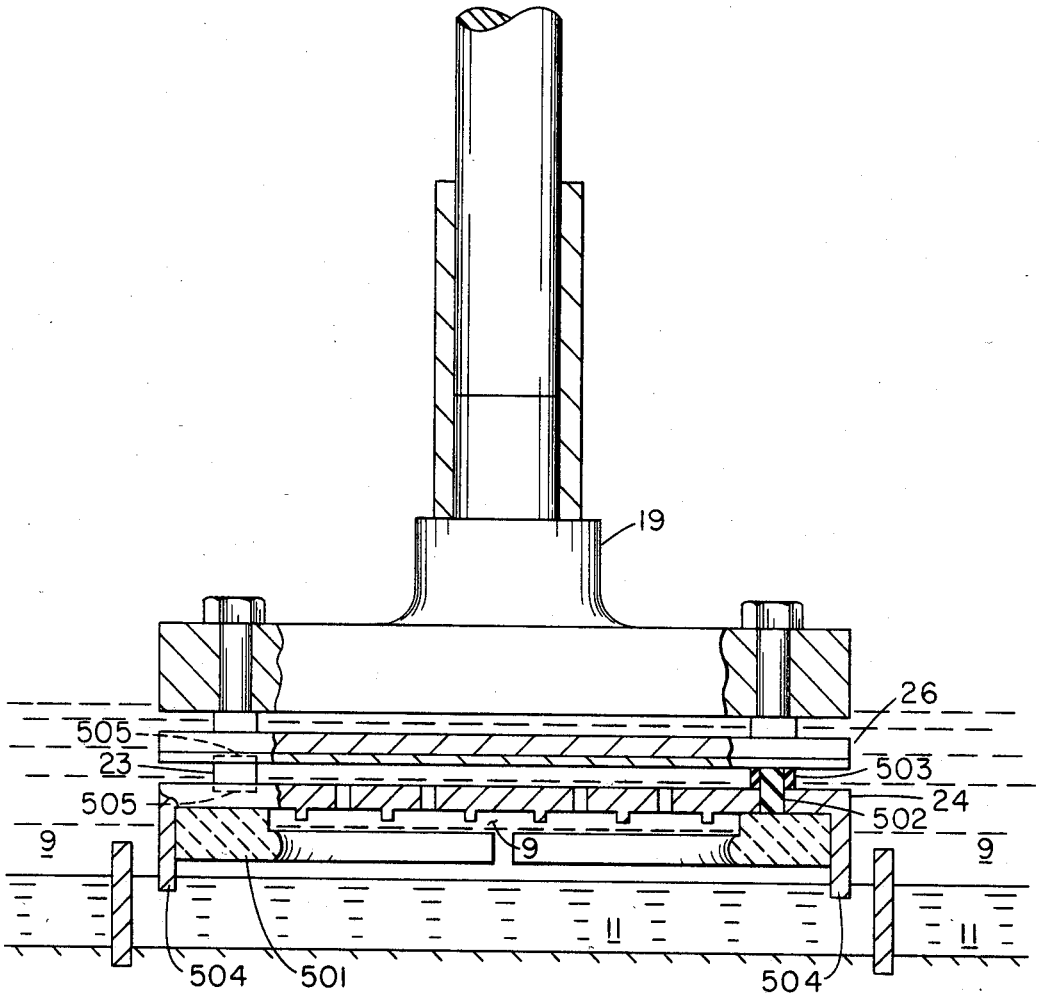

Referring now to FIG. 6, a bipolar electrode assembly incorporating a supporting means including a float support is illustrated. Anode 19 is positioned over bipolar electrode 26 and terminal cathode 24 having appendages 401 for contacting float 402. Appendages 401 are embedded in float 402, as shown. An alternative is to have appendages overlapping float 402 as illustrated in FIG. 7.

In the case of aluminum production from alumina dissolved in an electrolyte of cryolite, float 402 can be composed of graphite, which is a good electrical conductor such that current can be passed through the float support to the liquid pad, e.g., through float 402 to liquid metal pad 11 as in the embodiment illustrated in FIG. 6. Float 402 in such an embodiment comprises conductive means for connecting cathode 24 to pad 11. The graphite of float 402 furthermore is a material having a density less than an electrolyte bath 9 of cryolite, so that float 402 buoys up terminal cathode 24 and bipolar electrode 26 against shoulder pin spacers 403. Cathode 24 and bipolar electrode 26 thereby are free from support by any internal surface, e.g., floor 8 of the electrolytic cell.

Shoulder pin spacers 403 having shoulders 404 maintain the positioning of an inter-electrode zone 109 of specified dimension between terminal anode 19, bipolar electrode 26, and terminal cathode 24. Shoulder pin spacer 403 has portion 405 extending through anode 19 and fixed by fastener 406 on the end of anode 19 opposite the inter-electrode zone. Shoulder pin spacers 403 provide positioning means in an anode-cathode assembly having electrodes located at a predetermined position to form the inter-electrode zone of specified dimension. Spacers 23 can be used in lieu of a portion of shoulder spacers 403, e.g., the bottom portion illustrated here between cathode 24 and bipolar electrode 26. The electrodes preferably are provided with grooves or receptacles 505 established in proper alignment in adjacent electrodes to constrain movement of the spacer and adjacent electrodes. Guides 407 can be positioned in cell floor 8 such that the float and the cathode will not move from a position substantially beneath terminal anode 19. Guides 407 alternatively can take the form of extensions (not shown) of an electrode, e.g., substantially vertical extensions of a horizontal anode to maintain an adjacent horizontal cathode surface substantially beneath the horizontal anode. Such extensions should be composed of an electrically insulating material.

Terminal cathode 24 has reinforcing ribs 408 for strengthening the cathode plate. Slots or perforations 112 are positioned in cathode 24 to form a cathode grate for facilitating run-off of electrolytic product formed at the cathode surface. Float 402 can contact and support cathode 24 immediately underneath cathode 24, e.g., in abutment (not shown) to reinforcing ribs 408.

Bipolar electrode 26 has a composite, laminated construction such that cathode portion 411 is constructed of a material particularly adapted to function as a cathode, e.g., a boride, and the anode portion 412, e.g., as illustrated here in one embodiment as the underside of substantially horizontal bipolar electrode 26, is constructed of a material particularly suited as an anode material as discussed hereinbefore.

Referring now to FIG. 7, float 501 is composed of an electrically insulating material, such as of porous ceramic. In such an embodiment, float 501 can have portion 502 which extends through cathode 24 to establish cathode 24 and the adjacent bipolar electrode in a relative position to form an inter-electrode zone of specified dimension. In the case where cathode 24 has a density lower than the electrolyte, ring spacer 503 can be fitted concentric to extension 502 to maintain the position of cathode 24 on extension 502. Float 501 is composed of a material having floatation and conductivity characteristics which are substantially unaffected by contact with the electrolyte or by immersion in the molten electrolytic product. In such an embodiment wherein float 501 is composed of an electrically insulating material, cathode 24 can have appendages 504 which extend into metal pad 11 and which provide conductive means for electrically connecting cathode 24 to pad 11.

In the case of the production of aluminum from alumina dissolved in cryolite, the float preferably is composed of an electrically conductive material as illustrated by float 402 in FIG. 6 and preferably is composed of a material comprising carbon, e.g., graphite. When electrolytic bath 9 comprises cryolite, float 402 composed of graphite preferably contacts the metal pad 11 of the cell and thereby becomes cathodic. In this way, consumption of the graphite by combination with oxygen gas produced at the anode is avoided. However, the graphite float should be protected from direct exposure to the cryolite both, e.g., by a protective coating layer.

Figure 8:
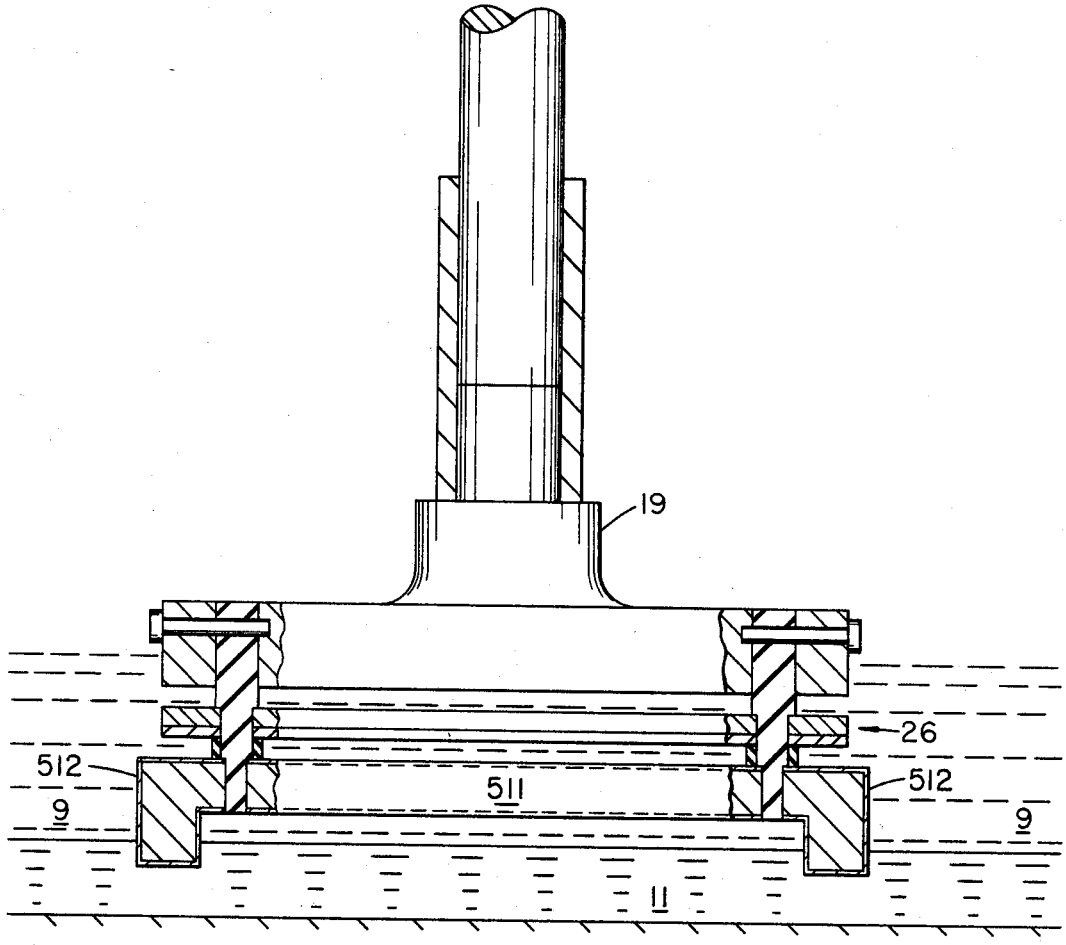

Referring now to FIG. 8, an electrode assembly is illustrated incorporating a float support comprising a substrate 511 of a buoyant material having a coating 512 of an electrically conducting material. Substrate 511 can be either electrically insulating or conductive. In the case of a substrate 511 of electrically insulating material, coating 512 of electrically conducting material must extend to contact metal pad 11 and form an electrical connection. Further in such a case of an electrically insulating substrate, coating 512 should be of sufficient thickness to carry the electrolytic current without a large voltage drop. Coating thickness will vary depending on the material used for the coating. Coating 512 comprises a material selected for properties providing enhanced cathode characteristics. For example in the case of aluminum production from alumina dissolved in a cryolite electrolyte bath, a preferred coating material is a refractory hard metal preferably comprising a boride such as titanium diboride. In this regard, a coating of titanium diboride over an electrically insulating material selected as substrate 511, e.g., a porous ceramic, would need to have a thickness in the range from about 0.010 inch to about 0.100 inch.

Nevertheless, a preferred embodiment of a float support means having coating 512 incorporates the use of an electrically conducting material as substrate 511. For example, in the production of aluminum by the electrolysis of aluminum oxide dissolved in a cryolite bath, substrate 511 can be graphite. In such an embodiment, coating 512 can have a significantly reduced thickness, e.g., in the range from about 0.005 inch to about 0.010 inch, since the graphite will conduct the electrical current required in the electrolysis over a larger cross-sectional area at a lower voltage drop. Further, coating 512 must be applied only to the primary cathodic surface and need not extend into metal pad 11 when an electrically insulating substrate is used for substrate 511 in contact with the pad. However, a float support comprising graphite having a coating such as of a boride preferably is coated over that entire portion of the graphite which is exposed to a fluoride electrolyte bath, e.g., cryolite, to prevent degradation of the graphite.

Coating 512 is selected for properties providing high electrical conductivity; high wettability with the molten metal product produced in the electrolysis; and high resistance to the molten metal product as well as high resistance to corrosive attack by the electrolyte bath, not only to maintain its own integrity but also to protect the underlying substrate. In the case of aluminum production by the electrolysis of alumina dissolved in an electrolyte bath of cryolite, the coating can be a refractory hard metal such as a boride, e.g., titanium diboride, to meet these criteria and also for practical considerations of a low cost to benefit ratio.

Coating 512 can be deposited on substrate 511 by known coating methods such as chemical vapor deposition, reactive physical vapor deposition, or by plasma spraying.

In the broader context of the present invention, the anode may or may not be composed of a material inert to the intended electrolytic environment. In the case where the anode is not inert, e.g., in a consumable anode such as a carbon anode in cryolite, the float support is the preferred embodiment of the means for supporting an electrode such as, e.g., a cathode, essentially free from support by an internal surface of the containing means, e.g., the internal floor, of the cell. In such a preferred embodiment, the float will buoy the cathode against a spacer positioned to form the inter-electrode zone of a specified dimension despite anode consumption during operation of the cell.

Figure 9:
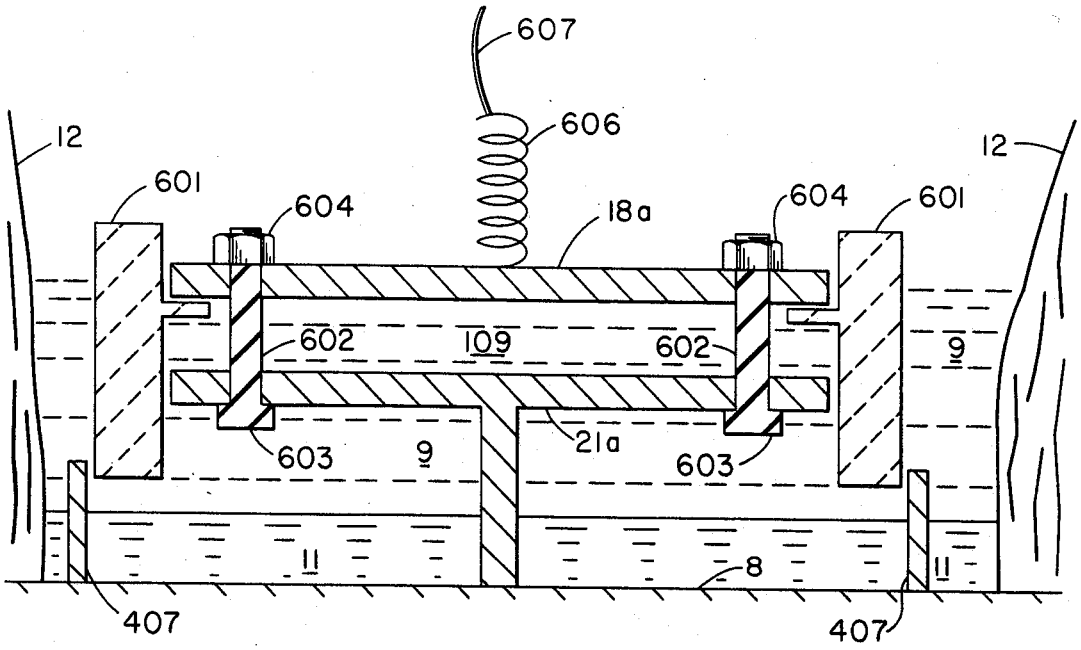

FIG. 9 illustrates an embodiment of the cell of the present invention having first and second electrodes and a float means for supporting the first electrode essentially free from support by an internal cell surface, e.g., the floor or wall, wherein the second electrode is connected to a separate liquid pad having a higher conductivity than the electrolyte. Anode **18*a* is supported free from floor 8 or side walls 12 by float 601. In the embodiment illustrated here, float 601 is composed of an electrically insulating material, such as a porous ceramic material. An electrically insulating material is required since float 601 contacts anode 18*a* and further contacts metal (not shown) overflowing and contacting cathode 21*a*. Spacer means 602 are employed for positioning anode 18*a* relative to cathode 21*a*. Spacer means 602 comprises a pin main body 602 extending through cathode 21*a* and terminating with lip shoulder 603. The other end of spacer means 602 extends through anode 18*a* and terminates by threaded connection to a fastener such as nut 604. But for float 601, anode 18*a* is free to ride up or down on spacer means 602. Cathode 21*a* is supported by floor 8, which over time will warp and move in electrolytic cells having harsh operating conditions, such as in the electrolysis of alumina to produce aluminum using a fluoride electrolyte. Nevertheless, float means 601 operating in combination with spacer means 602 will maintain an essentially fixed anode-cathode distance in inter-electrode zone 109 despite movement in floor 8**.

Guides 407 are positioned in floor 8 to maintain float 601 aligned under anode **18*a*. Flexible connection 606** provides an electrical contact between anode 18*a* and electrical cable 607 connected to an electrical power supply.

Adjusting means, shown here in one embodiment in the form of a nut 604 threadably adapted to spacer 602, can vary the anode-cathode distance established by spacer 602, thereby providing an adjustable or variable spacer means. Alternatively, a fixed spacer in the form of a spacer 23 (as shown in previous figures) or a concentric sleeve to spacer 602 (as shown in subsequent figures, e.g., positioning means 704 as shown in FIG. 10) can be incorporated to establish a fixed anode-cathode distance, e.g., at a minimum anode-cathode distance established between anode 18*a* and cathode 21*a* by drawing down anode 18*a* to such a fixed spacer or sleeve (not shown).

Figure 10:
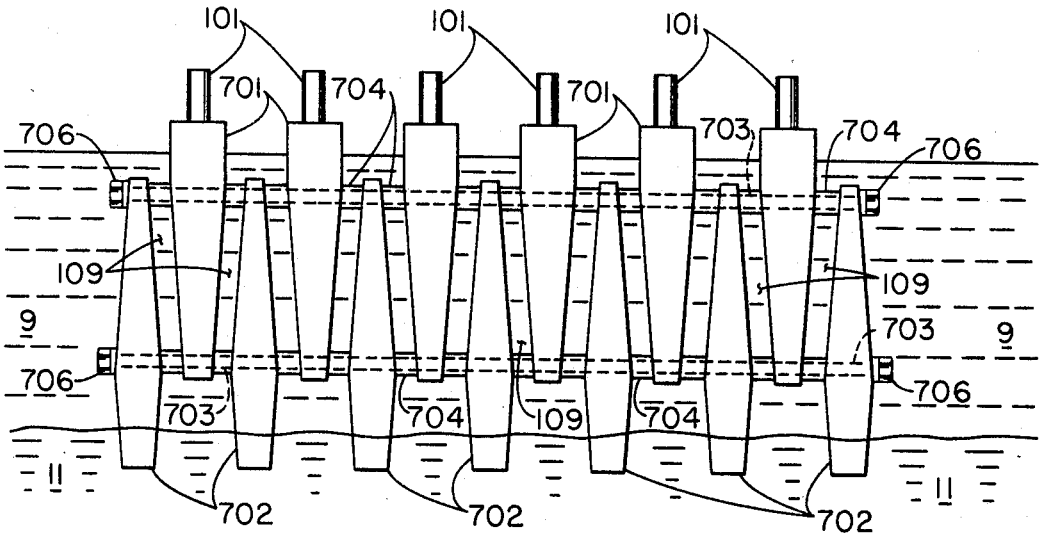
FIG. 10 is an elevational view of an electrolytic cell in accordance with the present invention, incorporating inclined or nonhorizontal monopolar electrode surfaces.

Referring now to FIG. 10, an electrolytic cell of the present invention is illustrated having inter-electrode zone 109 formed by an anode-cathode interposition of inclined or nonhorizontal monopolar anodes 701 and similarly disposed monopolar cathodes 702. The anodes 701 are electrically connected to nickel bus connectors 101 and the cathodes 702 are each electrically in contact with liquid pad 11 wherein collects liquid product from electrolysis in the inter-electrode zones 109. A slanted, e.g., inclined or tapered, electrode surface with essentially parallel anode-cathode relationships is preferred over vertical interpositioning for reasons of reducing the potential for reoxidizing down-flowing metal. The tapered electrodes act to channel evolved gas along the anode and away from the cathode. A slanted or inclined relationship also facilitates adjustment of the anode-cathode distance by moving the anode of the cathode up or down.

Means for supporting and for positioning the electrodes to form inter-electrode zone 109 of specified dimension are illustrated here each in one embodiment, respectively, as pin supporting means 703 and sleeve positioning means 704 each similar in material properties to spacer 23 as illustrated in previous figures and as described hereinabove. Pins 703 extend through the anodes and cathodes and terminate in fasteners 706 such as nuts threadably adapted to pins 703 such that anodes 701 and cathodes 702 can be tightened against spacer sleeves 704 to form interelectrode zone 109 of a specified dimension.

In the inclined monopolar electrode assembly shown in FIG. 10, with the exception of the end electrodes, each anode and each cathode operates in conjunction with two adjacent oppositely charged monopolar electrode surfaces. Inclined electrode surfaces also may be utilized in a bipolar arrangement, e.g., two terminal anodes positioned on either end of an inclined bipolar electrode assembly together with a terminal cathode in the middle having connection electrically with the liquid pad. In such a bipolar cell (not shown, the current flows from an outside anode inwardly through one or more bipolar electrodes and finally to the central terminal cathode. Alternatively, the outside electrodes can contact the metal pad, and current can be made to flow from a central terminal anode through one or more bipolar electrodes to the outside electrodes each serving as a terminal cathode.

Figure 11:
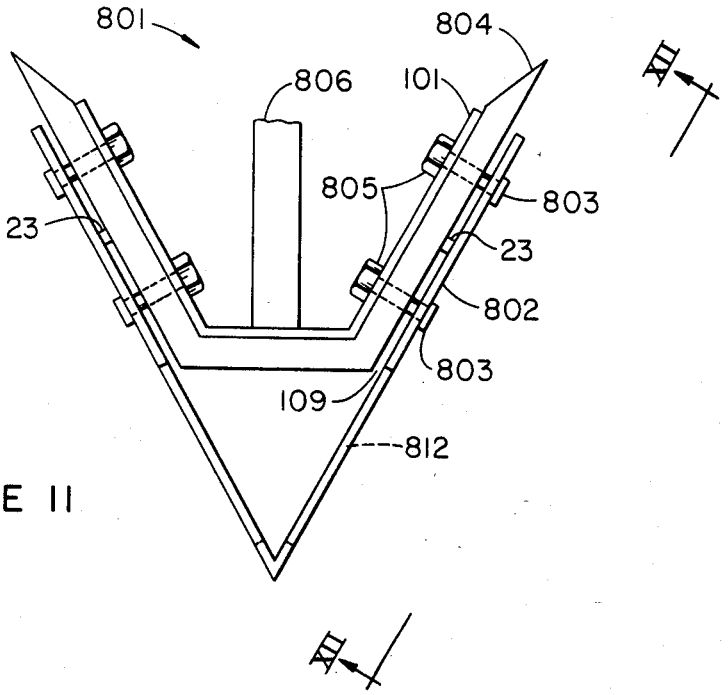
FIG. 11 is an elevational view of an inclined electrode assembly in accordance with the present invention.

FIG. 11 illustrates an embodiment of the electrolytic cell of the present invention having inclined electrode assembly 801. Cathode 802 is adapted to hang on pin 803 a specified dimension below anode 804. Spacer 23 is positioned between cathode 802 and anode 804 such that when pin 803 and adjusting means 805, e.g., as shown here in the form of a nut threadably adapted to pin 803, adjusts the electrodes against spacer 23, inter-electrode zone 109 takes on an essentially fixed anode-cathode distance. Bus 806 connected to an electrical power supply carries current to current transfer material 101 such as nickel. Slots or perforations are provided in cathode 802 as more fully illustrated in FIG. 12.

Figure 12:
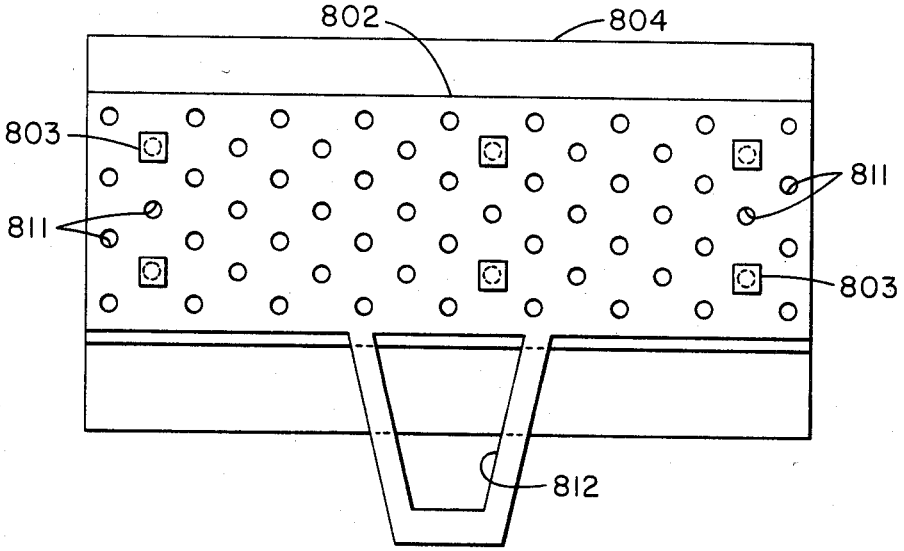
FIG. 12 illustrates a side elevational view of the electrode assembly shown in FIG. 11.

FIG. 12 shows a side view of electrode assembly 801. Slots or perforations 811 in cathode 802 are illustrated. The lower extension of cathode 802 appears as a tail portion, having cut-out 812, for dipping into the separate liquid pad (not shown) having a higher conductivity than said electrolyte, e.g., the pad of metal product. Slots or perforations 811 and cut-out 812 are provided to facilitate the run-off of electrolytic product liquid from cathode 802 and further to facilitate the feed of fresh electrolyte to the inter-electrode zone, i.e., to the region of electrolysis located between the electrodes.

Figure 13:
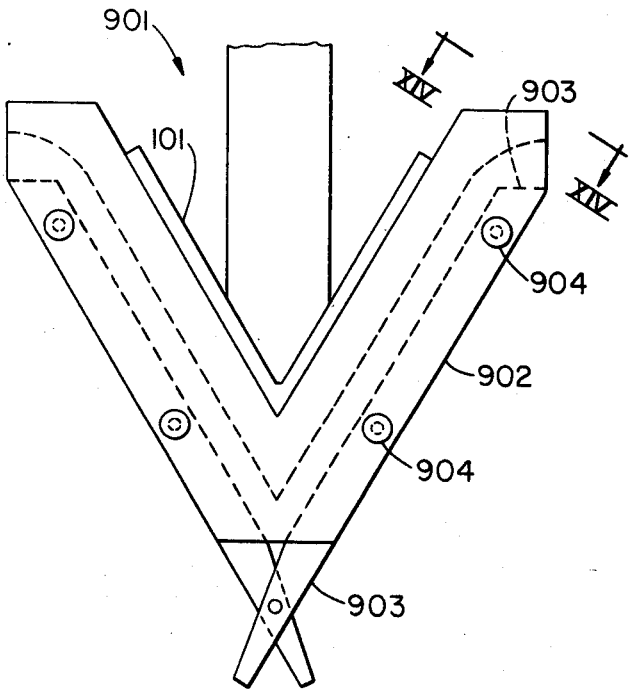
FIG. 13 is an elevational view of an inclined electrode assembly according to the present invention.
Figure 14:
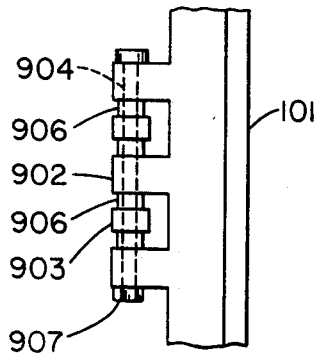
FIG. 14 illustrates an end view of the anode-cathode structure of the electrode assembly shown in FIG. 13 taken along section lines XIV.

Referring now to FIG. 13, an electrode assembly 901 is shown having inclined anode 902 encompassing partially exposed inclined cathode 903 located interior to and surrounded on three sides by anode 902 as more fully illustrated in FIG. 14. Pin 904, of electrically insulating material inert to the electrochemical environment, runs the entire depth of the electrode assembly to support cathode bars 903 from anode 902, as more fully depicted in FIG. 14.

FIG. 14 illustrates an end view of the anode-cathode structure of the inclined electrode assembly shown in FIG. 13 taken along end view XIII. Electrically insulating spacer means 906, e.g., as illustrated here in one embodiment in the form of a sleeve concentric to pin 904, operate to position cathode 903 relative to anode 902. Adjusting means 907 in the form of a nut threadably adapted to pin 904 is used to facilitate the assembly of the anodecathode structure.

Figure 15:
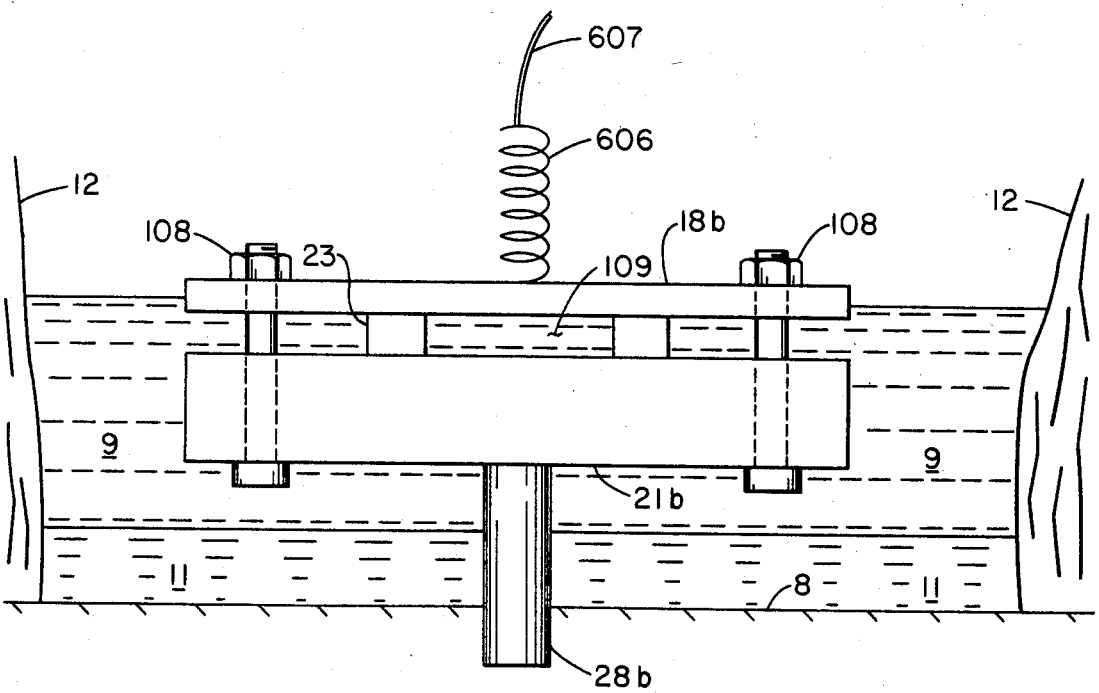
FIG. 15 is an elevational view of an electrolytic cell in accordance with the present invention and incorporating a flexible electrical connection to an anode held essentially free from support by an internal wall or floor surface of the cell.

Referring now to FIG. 15, and electrolytic cell is illustrated incorporating a first electrode held essentially free from support by an internal cell surface and a second electrode connected electrically to a liquid pad of higher conductivity than the electrolyte. Flexible means 606 makes an electrical connection between anode 18*b* and an electrical power source (not shown) through cable 607. Anode 18*b* is held essentially free from support by an internal cell surface such as floor 8. In the embodiment shown, cathode 21*b* has tail 28*b* which is supported by floor 8, and anode 18*b* is supported by cathode 21*b*. Spacers 23 and adjusting means 108 combine to position anode 18*b* and cathode 21*b* and form inter-electrode zone 109 of specified dimension. Inter-electrode zone 109 will not vary substantially despite movement by floor 8 and consequent movement by cathode 21*b*.

The present invention in one aspect provides means for holding the cathode in position relative to the anode while supporting one electrode essentially free from support by the internal surfaces of the cell and further while at the same time incorporating means for electrically contacting the cathode to the liquid pad of electrolytic product. Nevertheless, even when the cathode comprises the electrode held essentially free from support by internal cell surfaces, the cathode may contact the internal surfaces of the cell so long as such a contact is not necessary for a rigid support of the cathode or so long as such a contact will not impair electrode positioning and alter the specified inter-electrode spacing as in the case where the anode consists of the one electrode held essentially free from support by an internal cell surface. Preferably however, the cathode does not contact the internal surfaces of the cell. In either case, the essential point is that one electrode is constrained in three-dimensional space only with respect to the other electrode and not with respect to an internal cell surface for containing electrolyte or electrolytic product.

The present invention provides conductive means for electrically connecting a first electrode to the liquid pad of higher conductivity than the electrolyte. The electrode so connected can be the one electrode constrained in three-dimensional space only with respect to another electrode, e.g., in other words, held essentialy free from support by an internal cell surface, or the electrode so connected can be the other electrode. In the latter case, i.e., where the electrode connected to the liquid pad is not necessarily held essentially free from support by an internal cell surface, then the electrode held free preferably can be flexibly connected electrically to an electrical power source.

In this way such an electrical power source will not place a constraint in three-dimensional space on the electrode held essentially free from support by the internal cell surface.

In some electrolytic cells, one electrode can be supported through the internal side wall of the cell, e.g., such as that shown in Jacobs, U.S. Pat. No. 3,745,107. Such a structural limitation can be accommodated by the cell and method of the present invention. When this type of an electrode support through the internal side wall is accommodated by the present invention, typically the other electrode will be the electrode held essentially free from support by an internal cell surface and further will be the electrode connected electrically to the liquid pad having a conductivity higher than that of the electrolyte.

The present invention includes means for holding one of the electrodes in position relative to the other to form an inter-electrode zone for containing electrolyte. Such means for holding can comprise means for supporting one electrode from another and further can comprise means of electrically insulating material for positioning the electrodes.

A special advantage of the electrolytic cell in accordance with the present invention is the ability to establish and maintain an inter-electrode zone having a specified dimension. Further, when essentially inert electrodes are incorporated into such a cell, the inter-electrode zone of specified dimension can be made to become an essentially fixed, spaced relationship between electrodes to achieve an inter-electrode zone of essentially fixed anode-cathode distance. Such a fixed anode-cathode distance was previously unachievable with convention electrode assemblies not only because of problems attributable to consumable electrodes, but also because conventional electrodes were supported by the cell floor or walls. A fixed anode-cathode distance in such an electrode assembly supported by the internal cell floor or walls would have been destroyed by problems associated with cell lining deterioration attributable to penetration of electrolyte and liquid electrolytic product as well as intercalation of other metallic species present in the electrolyte, such as sodium in cryolite, which causes swelling, warping, and deformation of the internal cell surfaces, e.g., the internal carbon floor and walls of the aluminum-producing electrolytic cell.

The means for positioning, e.g., as illustrated in one embodiment designated as spacer 23 in some of the figures, must be of a material which is electrically insulating; must be substantially inert to the bath at operating temperatures, which temperatures in the case of commercial electrolytic aluminum production from alumina dissolved in cryolite are typically in the range of about 920° C. to about 1000° C.; must be stable in the presence of dissolved metal or suspended or agglomerated, molten metal produced in the electrolysis; and must not react substantially with anode products of the electrolysis, e.g., in the production of aluminum from alumina dissolved in cryolite oxygen gas when using inert anodes or CO and $CO_2$ gas when using carbon anodes. Materials such as nitrides and oxynitrides, including boron nitride, silicon nitride, silicon oxynitride, aluminum oxynitride, or an oxide/mixed oxide such as a ceramic oxide or a carbide or nitride/carbide composite having a low electrical conductivity are suitable materials for the positioning means of the present invention. Suitable ceramic oxides for resistance to oxygen attack include, but are not limited to, materials such as stannic oxide, cobaltic oxide, iron oxide, or a mixture of nickel oxide and iron oxide.

A one-piece spacer-hanger, that is, a one-piece member, e.g., a support bracket serving as the means for holding including functioning as a means for supporting the electrodes essentially free from support by an internal surface of the cell and also functioning as means for positioning the electrodes to form an inter-electrode zone of specified dimension, can offer the advantage of not detracting from or reducing the surface area of the anode-cathode inter-electrode zone, since a spacer, as shown by spacer 23 in the figures, is not needed. However, a spacer as contemplated for one embodiment of the means for positioning of the present invention, e.g., an element to be inserted between the electrodes to maintain the electrodes in position relative to one another, comprising a member separate from the means for supporting offers the advantage of being easier to construct and fabricate in the form of suitable shapes and further offers the advantage of requiring only sufficient compressive strength rather than tensile strength, which compressive strength can be provided more readily by otherwise suitable materials. In this regard, when a float is used as the means for supporting a cathode essentially free from support by the internal surface of the cell, no support bracket or hanger is needed, and any requirement for sufficient substantial tensile strength is thereby avoided.

The float supporting means as contemplated may be electrically conductive in the case when it is positioned beneath both electrodes, such as when supporting the bottom electrode in a horizontal stack essentially free from support by an internal cell surface, and essentially no voltage drop is present ordinarily to cause it to engage in electrolysis. Moreover, when the float has good electrical conductivity, it also can be adapted to comprise the means for electrically contacting the adjacent electrode with the liquid pad having a conductivity higher than the electrolyte, such as in the case of contacting the cathode to the molten metal pad of electrolytic product.

The cell of the present invention comprises the establishment of a cathode consisting of a cathode surface other than the surface of the liquid pad of electrolytic product and also includes means for facilitating run-off of electrolytic product, such as molten metal, formed on such cathode surface. The cell of the present invention further includes means for channeling gas from the anode surface, such as channeling oxygen gas as a product of the electrolysis of alumina dissolved in cryolite from an inert anode surface.

Means for channeling gas away from the primary anodic surface will reduce problems of poor current efficiency, and consequently will improve power efficiency. Such channeling means can take the form of inclined, i.e., nonhorizontal, channels coursing through the anode in a direction to convey gas away from the primary anodic surface. Moreover, such inclined means for channeling gas also provides means for circulating electrolyte salt bath through the inter-electrode zone, the gas providing the motive force for establishing "fresh" electrolyte of acceptable composition within the inter-electrode zone. The flow of electrolyte bath through the inter-electrode zone sweeps metal from the cathode thereby preventing the formation of large metal droplets which could short circuit the inter-electrode zone. Inclined or sloping channels act to increase the velocity and reduce the depth of the gas as it moves through the channels. Substantially horizontal channels can be employed if the channels are made large enough to accommodate an otherwise deeper gas flow attendant with a lower velocity.

Means for facilitating run-off of molten metal formed on the cathode will reduce problems attributable to an accumulation or agglomeration of metal on the cathode at the primary cathodic surface and can be provided by using the face of a cathode grate or perforated plate as the terminal cathode and by using grooves in the primary cathodic surface forming the top portion of a bipolar electrode. Such a cathode in the case of aluminum production preferably is composed of a material comprising a refractory hard metal such as a boride and preferably the diboride of titanium for reasons of cost to benefit considerations. Titanium diboride provides a cathode surface which is wetted with a thin film of aluminum electrolytic product. The aluminum product forming at the wetted cathode does not build up through the agglomeration of non-wetting droplets on the cathode but rather overflows the bipolar electrode or drips through the grate or perforated plate of the terminal cathode to a liquid pad of molten metal contained below by the internal surfaces of the cell. The $TiB_2$ surface can be provided as a coating over a less expensive metal substrate, e.g., as a $TiB_2$ coating applied by plasma spraying on a nickel support.

Conductive means for electrically connecting one electrode to the pad are provided in one embodiment of the present invention for such a primary cathodic surface maintained above the liquid pad by conductive means which can take the form of a tail portion on the cathode. The conductive means for electrically connecting an electrode to the pad can be provided by means other than a tail portion dipping into the liquid pad, for example, a block-shaped extension of the cathode dipping into the pad. A tail portion of an electrode is the preferred embodiment of the conductive means since such a design requires less material and enhances the run-off of electrolytic product such as reduced metal from a primary cathodic surface by providing more volume for run-off flow, which enhanced run-off can be important for maintaining a specified and significantly reduced anode-cathode distance.

The combination of the preferred grate design of the primary cathodic surface and the conductive means for electrically connecting such a surface to the liquid pad of electrolytic product along with the appropriate materials for the cathodic surface form an important combination with the other elements of the electrolytic cell of the present invention in this one aspect to overcome long-standing problems and obstacles preventing a reduced anode-cathode distance, including the induced displacement of molten product which causes shorting in conventional electrolytic smelting processes for producing metal and particularly in Hall-Heroult cell smelting for producing aluminum. Any such induced displacement of metal becomes more severe as amperage is increased, and the cell and process of the present invention in overcoming problems attributable to such displacement consequently allow for electrolytic smelting of a metal such as aluminum at higher amperage rates.

A preferred embodiment of the process of the present invention includes controllably discharging material from the liquid pad in the cell to maintain a primary cathodic surface above the pad. Such discharging becomes important at appropriate times to avoid flooding the cathode grate or perforated plate thereby preventing product run-off from the cathode surface.

The cell of the present invention is particularly suitable for the production of a metal, such as aluminum, from an electrolyte of a molten salt bath containing a compound intended for electrolysis, such as alumina or aluminum oxide dissolved in cryolite. The cell is capable of providing a specified anode-cathode distance in the electrolytic production of aluminum of less than about 2.4 cm, preferably less than about 1.7 cm, and more preferably in the range of about 0.3 cm to about 1.0 cm and further is capable of maintaining such a small anode-cathode distance for long time periods. A low anode-cathode distance is preferred to achieve a reduced voltage drop across the electrolyte contained therein. However, even with the cell and process of the present invention a lower limit must be observed to prevent electrical shorting and to generate sufficient resistance heating to operate the cell continuously.

The specified anode-cathode distances which the cell of the present invention is capable of providing, including the preferred ranges of such specified anode-cathode distances, and other operating parameters of the cell and process of the present invention are compared to conventional Hall-Heroult process with data given in Table I. Monopolar and bipolar illustrative embodiments of the cell and process of the present invention retrofitted in a Hall-Heroult cell are compared to the conventional Hall-Heroult process in such a cell.

As illustrated in Table I, a conventional Hall-Heroult process cell currently operates at a cell ampere load of about 172,000 amperes with a heat loss of about 380,000 W. Cell voltage is about 4.49 volts corresponding to about 6.53 kWh/lb. Current efficiency in such a Hall-Heroult process is about 93% with a power efficiency of about 47%.

On the other hand, the cell and process of the present invention can operate at 172,000 amperes with a heat loss of about 165,000 W or less at an anode-cathode (A-C) distance of less than about 2.4 cm with significantly improved power efficiency.

In a monopolar embodiment of the present invention, the cell voltage can be reduced from that of the Hall-Heroult process of 4.49 to about 4.12 with the present invention. Similarly power per pound in kWh/lb improves from about 6.53 to about 5.99. Increasing the ampere load to 200 and to 240 kA at anode-cathode distances of about 1.7 cm and about 0.6 cm, respectively, increases lbs/pot day 16% and 40% with decreases in kWh/lb.

Surprising increases in efficiency and production occur when operating with a bipolar electrode assembly in accordance with the present invention. For example, the same cell retrofitted with bipolar electrodes to form three inter-electrode zones will increase production from less than 3,000 pounds to over 9,700 pounds of aluminum per pot day at a reduced kWh/lb. Production further increases dramatically by increasing the number of bipolar compartments to form more inter-electrode zones.

TABLE I

| | Improved Aluminum Production vs. Conventional Practice | | | | | | |
|---|---|---|---|---|---|---|---|
| | Conventional Hall-Heroult Cell | Monopolar Electrode One Inter-Electrode Zone | | | Bipolar Electrodes Inter-Electrode Zones | | |
| | | | | | (3) | (4) | (5) |
| Cell Ampere Load (kA) | 172 | 172 | 200 | 240 | 172 | 172 | 172 |
| A-C Dist. (cm) | 4.66 | 2.38 | 1.71 | 0.59 | 0.64 | 0.64 | 0.64 |
| Cell Voltage | 4.494 | 4.124 | 4.040 | 3.974 | 10.984 | 13.051 | 16.034 |
| kWh/lb | 6.535 | 5.997 | 5.874 | 5.778 | 4.658 | 4.651 | 4.646 |
| Heat Loss (kW) | 380 | 165 | 165 | 165 | 150 | 194 | 238 |
| Current Efficiency (%) | 93 | 93 | 93 | 93 | 318.9 | 392.8 | 466.6 |
| Power Efficiency | 47 | 75 | 76 | 77 | 89 | 86 | 87 |
| Lb/Pot Day | 2838 | 2838 | 3300 | 3961 | 9734 | 11,989 | 14,242 |
| Production vs. Conventional (%/pot) | 100 | 100 | 116 | 140 | 343 | 422 | 502 |

In view of the foregoing, a preferred embodiment of the electrolytic cell of the present invention includes the incorporation of at least one bipolar electrode positioned in a stacking relationship between a terminal anode and a terminal cathode.

In such a bipolar cell, a shoulder pin support member is preferred as the supporting means or means for suspending one electrode from the other. The shoulder pin can serve as the spacer in the form of a one-piece spacer-hanger and further is particularly adaptable for supporting the electrode assemblies in cells employing one or more bipolar electrodes.

The present invention is particularly suited for retrofit in present day Hall-Heroult cells for the production of aluminum, but the present invention will produce substantially less heat than a conventional cell's operation. For this reason, one embodiment for retrofitting an existing Hall-Heroult cell comprises the incorporation of extra insulation in a conventional Hall-Heroult cell retrofitted with an electrode assembly of the present invention, the insulation being limited and controlled to maintain a frozen electrolyte side wall to protect cell side wall lining.

Nevertheless, i.e., aside from the retrofit of Hall-Heroult cells for the production of aluminum, the cell and method of the present invention are adaptable to any electrolysis of compounds to reduce a metallic constituent of the compound wherein a pad of higher conductivity adjoins the electrolyte. Metal oxides dissolved in a fused salt bath electrolyte of higher decomposition potential may be subjected to electrolysis according to the present invention, and the liquid pad of higher conductivity than the electrolyte will comprise a pad of electrolytically reduced metal product. Not all metal oxides used in an electrolytic system in accordance with the present invention will form the liquid metal pad on the cell floor as in the case of the aluminum metal pad produced by the electrolysis of aluminum oxide dissolved in a cryolite electrolyte bath or in the case of the electrolysis of an electrolytic bath of zinc chloride or lead chloride. For example, an electrolytic cell and method according to the present invention and incorporating magnesium oxide dissolved in an electrolyte bath comprising a fused salt of higher decomposition potential, e.g., an alkali metal fluoride, would produce a liquid metal pad of magnesium formed at the top of the cell, since the magnesium produced would have a lower density than the electrolyte bath. In such a system which forms magnesium at the cell top, barrier means such as separate channels and barriers must be employed to maintain the magnesium metal separate from the anode product, e.g., oxygen or chlorine gas, e.g., in the case of electrolysis of magnesium oxide or magnesium chloride, respectively. Nevertheless, the present invention can be used to produce magnesium in a metal pad at the cell floor or bottom by incorporating an electrolyte bath of density lower than that of magnesium. For example, the electrolysis of magnesium chloride in a bath comprising sufficient amounts of lithium chloride will form such a liquid metal pad on the cell floor.

The present invention also is adaptable to other systems having a liquid pad of the requisite conductivity properties wherein the liquid pad is provided by a liquid material other than the metal product of the electrolysis, e.g., an aqueous electrolyte system having a mercury cathode. Such an electrolytic system is found in cells for producing chlorine and sodium hydroxide from sodium chloride, the sodium being electrolytically formed as reduced metal and dissolved in the mercury cathode which is subsequently treated, e.g., washed, to form the sodium hydroxide.

A start-up of the cell of the present invention in most cases will involve establishing an initial liquid pad of material representative of the pad of higher conductivity than the electrolyte, such as, e.g., representative of the intended electrolytic product metal, to establish an electrical contact, e.g., between the cathode and the current-carrying bus bars or liner of the cell. Initial electrical contact is made through the element of conductive means for electrically connecting the cathode to the initial liquid pad, which pad is electrically in contact with electrical current leads to the cell or with, e.g., a carbonaceous lining covering cell collector bars.

Electrolytic cells which are designed to circulate electrolyte bath through the cell are particularly suitable for use in the cell of the present invention.

What is claimed is:

1. An electrolytic cell for the production of metal from an electrolyte of a molten salt bath containing an oxygen compound in solution, said cell including means having an internal surface for containing said electrolyte and a molten pad of said metal, comprising:

a first terminal electrode having an anodic surface essentially inert to oxygen;

a second terminal electrode having a cathodic surface essentially inert to said metal and having means for electrically connecting said cathodic surface to said pad along a path of higher conductivity than the electrolyte;

at least one bipolar electrode positioned between said first and second terminal electrodes and having an anodic surface and a cathodic surface;

a spacer of electrically insulating material for positioning one said anodic surface a specified anode-cathode distance from one said cathodic surface; and a float for support said second terminal electrode and said bipolar electrode essentially free from support by said internal surface of said means for containing, said float being adapted to hold said electrodes against said spacer to form an inner-electrode zone of essentially fixed anode-cathode distance.

2. An electrolytic cell in accordance with claim 1 wherein said metal comprises aluminum, said electrolyte comprises cryolite containing dissolved alumina, and said float is composed of material comprising graphite or graphite having a refractory hard metal coating comprising a boride.

3. An electrolytic cell in accordance with claim 1 wherein said second terminal electrode has downwardly extending appendages for contacting said float means.

4. An electrolytic cell in accordance with claim 3 wherein said internal surface of said containing means comprises an internal cell floor and said cell floor further comprises vertical guides positioned in said floor to retain said second terminal electrode essentially beneath said bipolar electrode.

5. An electrolytic cell in accordance with claim 4 wherein said spacer is fixed to one electrode.

6. An electrolytic cell in accordance with claim 4 wherein said spacer comprises a one-piece member of insulating material extending through one electrode.

7. An electrolytic cell in accordance with claim 6 wherein said cathodic surface is composed of a boride material.

8. An electrolytic cell in accordance with claim 7 wherein said anodic surface is composed of a ceramic oxide.

9. An electrolytic cell in accordance with claim 8 wherein said essentially fixed distance is less than about 4.0 centimeters.

10. An electrolytic cell in accordance with claim 9 wherein said distance is less than about 2.4 centimeters.

11. An electrolytic cell in accordance with claim 10 wherein said distance is less than about 1.7 centimeters.

12. An electrolytic cell in accordance with claim 11 wherein said float means comprises an electrically conductive material and said float means contacts said pad.

13. An electrolytic cell in accordance with claim 12 wherein said liquid pad comprises aluminum, said electrolyte comprises molten alumina dissolved in molten cyrolite, and said float means is composed of a material comprising graphite or graphite having a refractory hard metal coating comprising a boride.

14. An electrode assembly for providing an anode and a cathode for an electrolytic cell, said cell including means having an internal surface for containing an electrolyte and a separate liquid pad of higher conductivity than said electrolyte, comprising:

a first electrode having anodic surface;

a second electrode having a cathodic surface;

conductive means for electrically connecting said first electrode to said pad along a path of higher conductivity than the electrolyte;

spacer means of electrically insulating material for positioning said anodic surface a specified anode-cathode distance from said cathodic surface; and a float for supporting said second electrode essentially free from support by said internal surface of said means for containing, said float being adapted to hold said electrodes against said spacer to form an inter-electrode zone of essentially fixed anode-cathode distance.

15. An electrode assembly in accordance with claim 14 wherein said second electrode has downwardly extending appendages for contacting said float.

16. An electrode assembly in accordance with claim 15 wherein said internal surface of said containing means comprises an internal cell floor and said cell further comprises vertical guides positioned in said floor to retain said second electrode essentially beneath said first electrode.

17. An electrode assembly in accordance with claim 16, said spacer means being fixed to one electrode.

18. An electrode assembly in accordance with claim 17 wherein said float and said spacer comprises a one-piece member of electrically insulating material extending through one electrode.

19. An electrode assembly in accordance with claim 18 wherein said first electrode comprises an essentially inert anode, said second electrode comprises an essentially inert cathode, and said specified dimension comprises an essentially fixed anode-cathode distance of less than about 2.4 centimeters.

20. An electrode assembly in accordance with claim 19 wherein said distance is less than about 1.7 centimeters.

21. An electrode assembly in accordance with claim 20 wherein said float means comprises an electrically conductive material and said float means contacts said pad.

22. An electrode assembly in accordance with claim 21 wherein said liquid pad comprises aluminum, said electrolyte comprises molten alumina dissolved in molten cryolite, and said float means is composed of a material comprising graphite or graphite having a refractory hard metal coating comprising a boride.

23. A method of electrolysis, comprising:

establishing a first and second electrode of a cell having an internal surface for containing an electrolyte and a separate liquid pad of higher conductivity than said electrolyte;

positioning said first electrode a specified anode-cathode distance from said second electrode by a spacer of electrically insulating material positioned between the electrodes;

floating said electrodes essentially free from support by said internal surface of the cell against said spacer positioned between said electrodes to form an inter-electrode zone for containing said electrolyte; and connecting one electrode electrically with said pad along a path of higher conductivity than the electrolyte.

24. A method in accordance with claim 23 wherein said floating said electrodes against said spacer forms an inter-electrode zone of essentially fixed dimension.

25. A method of electrolysis in accordance with claim 24 wherein said first electrode comprises an essentially inert cathode, said second electrode comprises an essentially inert anode, said essentially fixed dimension comprises an essentially fixed anode-cathode distance, and further comprising holding said cathode essentially beneath said anode.

26. An electrolytic cell for the production of aluminum from an electrolyte of alumina dissolved said cell including means having an internal in cryolite, said cell including means having an internal surface for containing said electrolyte and a molten pad of aluminum, comprising:

a first terminal electrode having an anodic surface essentially inert to oxygen;

a second terminal electrode having a cathodic surface essentially inert to aluminum and having means for electrically connecting said cathodic surface to said aluminum pad along a path of higher conductivity than the electrolyte;

at least one bipolar electrode positioned between said first and second terminal electrodes and having an anodic surface and a cathodic surface;

a spacer of electrically insulating material for positioning one of said anodic surface a specified anode-cathode distance less than about 2.4 centimeters from one said cathodic surface;

a float for supporting said second terminal electrode and said bipolar electrode essentially free from support by said internal surface of said means for containing, said float being adapted to hold said electrodes against said spacer to form an inter-electrode zone of essentially fixed anode-cathode distance;

downwardly extending appendages on said second terminal electrode for contacting said float means; and an internal cell floor in said containing means and vertical guides positioned in said floor to retain said second terminal electrode essentially beneath said bipolar electrode.

27. An electrolytic cell in accordance with claim 26 wherein said spacer and said float comprise a one-piece member of electrically insulating material extending through one electrode;

* * * * *